US009222282B2

(12) United States Patent
Russo et al.

(10) Patent No.: US 9,222,282 B2
(45) Date of Patent: Dec. 29, 2015

(54) ENERGY EFFICIENT MULTI-STABLE LOCK CYLINDER

(71) Applicant: NEXKEY, INC., Menlo Park, CA (US)

(72) Inventors: Peter R. Russo, Oakland, CA (US); Matthew Patrick Herscovitch, Melbourne (AU)

(73) Assignee: Nexkey, Inc., Menlo Park, CA (US)

( * ) Notice: Subject to any disclaimer, the term of this patent is extended or adjusted under 35 U.S.C. 154(b) by 0 days.

(21) Appl. No.: 14/475,442

(22) Filed: Sep. 2, 2014

(65) Prior Publication Data

US 2015/0101370 A1 Apr. 16, 2015

Related U.S. Application Data

(60) Provisional application No. 61/890,053, filed on Oct. 11, 2013.

(51) Int. Cl.
*E05B 21/06* (2006.01)
*E05B 35/00* (2006.01)
(Continued)

(52) U.S. Cl.
CPC ..... *E05B 21/066* (2013.01); *E05B 35/00* (2013.01); *E05B 47/0001* (2013.01);
(Continued)

(58) Field of Classification Search
CPC ..... E05B 47/0012; E05B 47/0001; E05B 2047/0058; E05B 47/02; E05B 47/026; E05B 47/0615; E05B 47/0642; Y10T 70/7062; Y10T 70/7102; Y10T 70/7107; Y10T 292/1021; Y10T 70/7068; Y10T 70/7079
USPC ..... 70/277, 278.1–278.3, 278.7, 279.1, 70/492, 493, 379 R, 380
See application file for complete search history.

(56) References Cited

U.S. PATENT DOCUMENTS 4,027,509 A * 6/1977 Funk et al. ..... 70/379 R
4,712,398 A 12/1987 Clarkson et al.
(Continued)

FOREIGN PATENT DOCUMENTS

DE 19906578 A1 8/2000
EP 0238360 A2 9/1987
(Continued)

OTHER PUBLICATIONS

International Search Report and Written Opinion mailed Jan. 15, 2015, for International Patent Application No. PCT/US2014/060179 filed Oct. 10, 2014.

*Primary Examiner* — Suzanne Barrett
(74) *Attorney, Agent, or Firm* — Perkins Coie LLP

(57) ABSTRACT

Some embodiments include a lock cylinder comprising: a plug assembly having a front portion and a back portion; a housing shell within which the plug assembly is rotatably disposed, wherein the housing shell includes a notch; wherein the back portion of the plug assembly comprises: a locking pin that is movably disposed, and wherein the locking pin is configured to prevent a rotation of the plug assembly when the locking pin is engaged in the notch and prevented from retracting by a multi-stable mechanism; and the multi-stable mechanism having at least two stable configurations corresponding to respectively to a locked state and an unlocked state, wherein the multi-stable mechanism can maintain the stable configurations without consuming energy; wherein, at a first stable configuration, the multi-stable mechanism prevents the locking pin from retracting, and, at a second stable configuration, the multi-stable mechanism enables the locking pin to retract.

15 Claims, 12 Drawing Sheets

(51) Int. Cl.
*E05B 47/00* (2006.01)
*G07C 9/00* (2006.01)

(52) U.S. Cl.
CPC ..... *E05B 47/0012* (2013.01); *E05B 47/0038* (2013.01); *G07C 9/00309* (2013.01); *G07C 2009/00634* (2013.01); *Y10T 70/625* (2015.04); *Y10T 70/7136* (2015.04); *Y10T 70/7588* (2015.04); *Y10T 70/7904* (2015.04)

(56) References Cited

U.S. PATENT DOCUMENTS

| | | | | |
|---|---|---|---|---|
| 5,027,629 | A * | 7/1991 | Liu | 70/277 |
| 5,373,718 | A * | 12/1994 | Schwerdt et al. | 70/278.3 |
| 5,685,182 | A * | 11/1997 | Chhatwal | 70/224 |
| 5,826,450 | A * | 10/1998 | Lerchner et al. | 70/278.3 |
| 5,839,305 | A * | 11/1998 | Aston | 70/283.1 |
| 5,841,363 | A * | 11/1998 | Jakob et al. | 340/5.26 |
| 6,282,931 | B1 * | 9/2001 | Padiak et al. | 70/279.1 |
| 6,310,411 | B1 | 10/2001 | Viallet | |
| 6,334,347 | B1 * | 1/2002 | Iscla | 70/278.3 |
| 6,370,928 | B1 * | 4/2002 | Chies et al. | 70/278.3 |
| 6,418,764 | B1 * | 7/2002 | Lerchner | 70/279.1 |
| 6,523,377 | B1 * | 2/2003 | Vonlanthen | 70/278.3 |
| 6,826,935 | B2 * | 12/2004 | Gokcebay et al. | 70/278.3 |
| 6,865,916 | B2 | 3/2005 | Goldman | |
| 7,073,359 | B2 | 7/2006 | San Jose Santamarta | |
| 7,231,791 | B2 * | 6/2007 | Sakai | 70/277 |
| 7,334,443 | B2 * | 2/2008 | Meekma et al. | 70/278.7 |
| 7,536,887 | B2 * | 5/2009 | Makino | 70/379 R |
| 7,591,160 | B2 * | 9/2009 | Keller | 70/277 |
| 7,823,427 | B2 * | 11/2010 | Katagiri | 70/379 R |
| 8,141,399 | B2 * | 3/2012 | Hyatt, Jr. | 70/278.3 |
| 8,146,394 | B2 | 4/2012 | Krueger | |
| 8,650,919 | B2 * | 2/2014 | Liu | 70/493 |
| 8,686,831 | B2 * | 4/2014 | Green et al. | 340/5.72 |
| 2001/0023602 | A1 * | 9/2001 | Doerr et al. | 70/278.3 |
| 2003/0217574 | A1 * | 11/2003 | Meis | 70/257 |
| 2004/0040355 | A1 * | 3/2004 | Goldman | 70/278.3 |
| 2006/0156771 | A1 * | 7/2006 | Hauri | 70/278.7 |
| 2008/0078220 | A1 * | 4/2008 | Kim | 70/283.1 |
| 2009/0007613 | A1 * | 1/2009 | Spycher et al. | 70/278.7 |

FOREIGN PATENT DOCUMENTS

| | | | |
|---|---|---|---|
| EP | 0388997 | A1 | 9/1990 |
| EP | 1443162 | A2 | 8/2004 |
| EP | 1746225 | A2 | 1/2007 |
| GB | 2476989 | A | 7/2011 |
| WO | 2010007196 | A1 | 1/2010 |

* cited by examiner

ENERGY EFFICIENT MULTI-STABLE LOCK CYLINDER

CROSS-REFERENCE TO RELATED APPLICATION(S)

This application claims the benefit of U.S. Provisional Patent Application No. 61/890,053, entitled "ELECTRONIC LOCKING SYSTEM AND METHOD," which was filed on Oct. 11, 2013, which is incorporated by reference herein in its entirety.

RELATED FIELD

At least one embodiment of this disclosure relates generally to a lock system, and in particular to an electronic lock system.

BACKGROUND

Mechanical locks have been around for thousands of years, and in recent decades electronic locks have come to market and been adopted by both businesses and consumers. While electronic locks offer substantial benefits over mechanical ones, if a business or consumer wishes to install an electronic lock at an existing door or other barrier, they often must replace much if not all of the existing locking hardware. Such an approach is costly. In addition to imposing a cost burden, the decision to change hardware may force the purchaser to change the aesthetic look of the door, drawer, or other locked barrier if the lock provider or locking system provider does not support the same style or finish of the existing lock hardware. Even if a business or consumer is installing a new door or other barrier rather than retrofitting, the purchase decision will likely reflect a mix of concerns such as cost, convenience/usability, security and aesthetics. An electronic lock that is small and that can essentially act as a component of many competitive locking systems would be highly valuable in both the retrofit and new door/barrier contexts. In addition to compactness, an electronic lock that is highly energy efficient is very valuable: high power consumption typically adds manufacturing cost due to the need for a more powerful (and often, more bulky) power supply, and it increases operating costs. If the power supply is replaceable (e.g., a battery), the need to replace the power supply more frequently adds maintenance costs and is less convenient.

DISCLOSURE OVERVIEW

Disclosed is a multi-stable mechanism for use with an electronic lock such that the electronic lock can be extremely compact and highly power efficient. In some embodiments, the electronic lock is a stand-alone device, such as an electronic padlock, and in other embodiments, the electronic lock is part of a locking system with additional components, either mechanical and/or electronic. In either case, an electronic lock generally operates by authenticating a user via some sort of analog or digital input and actuating a mechanical part to allow access through a barrier. For example, an electronic padlock would have a shackle that can be coupled to a barrier fixation assembly, which comprises one or more interlocking mechanical components (a simple example being a typical yard gate latch). In more complex implementations, the barrier fixation assembly (e.g., door lock assembly) can include a barrier fixation device that directly engages with the barrier (e.g., a deadbolt).

In some embodiments, the electronic lock can be included as part of a locking system, such as an electronic lock cylinder that plugs into a conventional lock assembly. In such embodiments, the electronic lock cylinder would include a "core" or "plug" assembly that can actuate a mechanical structure (e.g., the multi-stable mechanism) that enables the release (e.g., disengagement) of at least one of the interlocking mechanical components (e.g., a locking pin). In one example, the multi-stable mechanism enables an external force (e.g., a person's hand) to turn a plug assembly in the electronic lock cylinder and thereby retracting a locking pin. In this disclosure, "retract", "retracting", and "retraction" in reference to a locking pin refer to the movement of the locking pin to move away from a housing shell (e.g., toward the center of a rotor). This movement may be caused by a pulling or pushing force, such as a spring, a magnet, or other mechanisms. Likewise, in this disclosure, "extend", "extending", "extension", or "extendable" in reference to a locking pin refer to the movement of the locking pin to move or shift toward a notch in the housing shell. This movement may be caused by a pulling or pushing force, such as a normal force from a ramped surface in the housing shell against the locking pin while the plug assembly is being turned, or a force from a mechanism (e.g., a spring, a magnet, or other mechanisms). "Retractable" in reference to a locking pin refers to the ability for a locking pin to move away from a housing shell.

By releasing or disengaging the locking pin, the plug of the electronic lock cylinder is able to rotate. That rotation in turn can disengage another interlocking mechanical component or release the barrier fixation device. For example, if the electronic lock cylinder is placed in a typical deadbolt assembly, the rotation of the plug assembly can turn a tailpiece (that is attached to the plug assembly) and thereby enabling boltwork hardware attached to a door to release. The electronic lock cylinder can likewise re-lock the lock assembly using the multi-stable mechanism by re-engaging the locking pin to prevent the movement of at least one interlocking mechanical component and thus disabling disengagement of the barrier fixation device.

While a conventional lock cylinder may have multiple locking pins (or, in the case of cam locks, multiple discs) engaging with multi-bit physical keys, some embodiments of the disclosed electronic lock cylinder requires only a single locking pin. Because there is electronic circuitry to authenticate authorized users and to receive an electronic key, there is no need to use multiple pins or discs to extract identity information from a physical key.

In some embodiments, the disclosed lock cylinder is a modification of a conventional lock cylinder. Embodiments of the disclosed lock cylinder can be incorporated into a mechanism (such as a key-in-knob/key-in-lever set or a deadbolt assembly or a cabinet/drawer cam lock system) which includes security hardware that engages a barrier (e.g., a door lock's boltwork that engages a door jamb, or a cam lock in a drawer or cabinet that engages a plate, or "keeper," in the frame of the drawer or cabinet) when the lock cylinder is turned in one direction, and disengages the barrier when the lock cylinder is turned the other direction. Whether or not the lock cylinder can turn is often controlled by at least a locking pin between a plug assembly that can rotate and a housing shell that is fixed to the barrier and surrounds the plug assembly. When the lock cylinder is in a locked state, the locking pin engages in a notch in the housing shell and is unable to retract. When the lock cylinder is in an unlocked state, the locking pin can retract into the plug assembly and thus enable the plug assembly to be rotated, such as by a user or by an automated mechanism (e.g., a motor).

In some embodiments, the electronic lock is an electronic lock cylinder having a housing shell and a plug assembly in the housing shell. The housing shell can be any structure outside of the plug assembly, the housing shell being stationary relative to the plug assembly allowing the plug assembly to rotate therein. The plug assembly can have a front portion that protrudes from the housing shell and a back portion surrounded by the housing shell. For example, the entire electronic lock cylinder can fit into a conventional door lock. An electronic circuitry in the plug assembly can interpret a wireless signal to authenticate a nearby mobile device. For example, an antenna can be fitted in the front portion and the electronic circuitry fitted in the back portion. Once the electronic circuitry authenticates the mobile device, the electronic circuitry can actuate a multi-stable mechanism from a locked state to an unlocked state. The multi-stable mechanism is a mechanical structure that prevents retracting of a locking pin at the locked state and allows retracting of the lock pin at the unlocked state. The multi-stable mechanism requires energy to go from one state to another, but does not continuously consume energy to sustain a state once the state is reached. For example, the multi-stable mechanism can be a rotor, a cam lobe, a spring structure, or any combination thereof. The electronic circuitry can actuate the multi-stable mechanism via an actuation driver, such as a DC motor, a solenoid actuator, or other mechanical driving means.

In various embodiments, the multi-stable mechanism can have at least two stable configurations (e.g., rotation and/or position). In some embodiments, the multi-stable mechanism can have more than two stable configurations. In some embodiments, one or more stable configurations correspond to the locked state and one or more stable configurations correspond to the unlocked state. For example, the multi-stable mechanism can have four sequential configurations (e.g., sequential in the sense of rotation or position), where the configurations alternate between the locked state and the unlocked state. In some embodiments, once the multi-stable mechanism leaves a stable configuration, a mechanical force (e.g., via one or more magnets or one or more springs) pushes the multi-stable mechanism towards another stable configuration.

The multi-stable mechanism advantageously improves energy efficiency. For example, in order to lock or unlock, the electronic lock only has to move (e.g., rotate or shift) at least a portion of the multi-stable mechanism. The disclosed electronic lock does not need to expend energy in maintaining a locked state or an unlocked state. In some embodiments, change of state to the multi-stable mechanism enables the disengagement and engagement of the barrier fixation device without needing to move the barrier fixation device. For example, an ergonomic interface (e.g., a knob or a thumb lever) implemented at the front portion of the plug assembly can be used to enable a person to rotate the plug assembly once the multi-stable mechanism is in an unlocked state.

In some embodiments, a person can mechanically turn the multi-stable mechanism from an unlocked state to the locked state. In some embodiments, a person can use a mobile device to send an electronic signal to the electronic circuitry to instruct the actuation driver to return the multi-stable mechanism to the locked state. In some embodiments, the multi-stable mechanism can return to the locked state in response to the rotation of the plug assembly. This provides an advantageous security mechanism to ensure that a person does not forget to lock after entry through the barrier.

Some embodiments of this disclosure have other aspects, elements, features, and steps in addition to or in place of what is described above. These potential additions and replacements are described throughout the rest of the specification

The figures depict various embodiments of this disclosure for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
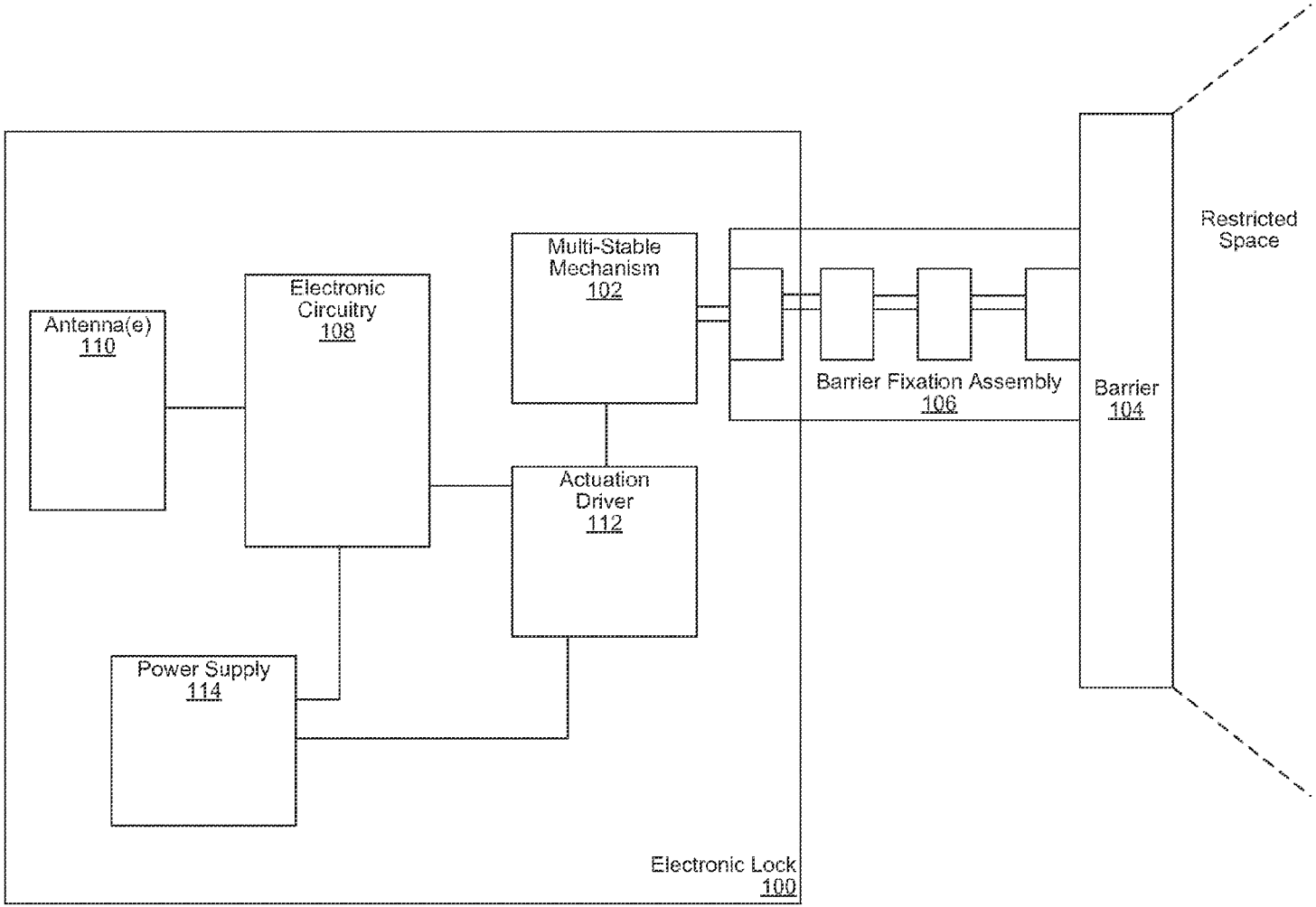
FIG. 1 is a block diagram of a system environment of an electronic lock securing access via a multi-stable mechanism, in accordance with various embodiments.

FIG. 1 is a block diagram of a system environment of an electronic lock 100 securing access via a multi-stable mechanism 102, in accordance with various embodiments. For example, the electronic lock 100 can be a device that incorporates a bolt, cam, shackle or switch to secure an object, directly or indirectly, to a position, and that provides a restricted means of releasing the object from that position. The electronic lock 100 can be part of a locking system (i.e., a greater lock assembly that includes or is coupled to the electronic lock 100). For example, the electronic lock 100 may be embodied as a variety of locks and locking systems, such as a lock cylinder that is an integrated component (and cannot be removed from) a locking system, or, preferably as a lock cylinder that is designed to substitute for a replaceable lock cylinder component of a locking system. In either case, examples of locking systems that might include the electronic lock cylinder include, without limitation, deadbolts, door knob/lever locking systems, padlocks, locks on safes, U-locks such as those used for bicycles, cam locks such as those used to secure drawers or cabinets, window locks, etc. The electronic lock 100 is a set of mechanical and electronic components for preventing or allowing access to a restricted space. The electronic lock 100 can also perform authentication of an external object (e.g., a mobile device or person). The electronic lock 100 can be coupled (e.g., directly or indirectly) to a barrier 104, such as via a barrier fixation assembly 106 that secures the barrier 104. The barrier fixation assembly 106 comprises one or more interlocking components (e.g., a rotating plug with a locking pin, a housing shell, bolt hardware, or any combination thereof, along with a strike plate or other receiving location for bolt hardware, such as a hole in a door jamb) that together prevent movement of the barrier 104 when the barrier fixation assembly 106 is engaged. The electronic lock 100 can include or at least control one of the interlocking components.

The electronic lock 100 can prevent or allow access through the barrier based on the result of the authentication process. For example, the authentication process can include the electronic lock 100 receiving an electronic key (i.e., information used to authenticate) via electronic circuitry 108. The electronic circuitry 108 can include or be coupled to one or more antenna(e) 110 for receiving wireless signal encoded with the electronic key. For example, the antenna(e) can receive an electronic key (e.g., identity information from a mobile device, such as a smart phone, a wearable device, or a key fob, possessed by a user who is requesting access). The electronic key can positively identify the user and may enable the authentication and/or authorization of the user for access. Accordingly, the electronic lock 100 does not require a keyhole, because the electronic key can be obtained wirelessly without physical contact with the source of the electronic key. The electronic lock 100, or the locking system in which it resides, may include a keyhole to enable a "backup" method of unlocking by use of a physical key, or to enable removing the electronic lock cylinder from the front of the locking system as is commonly implemented with certain mechanical lock cylinders marketed as "interchangeable core" lock cylinders.

The electronic lock 100 allows or prevents entry by switching between stable configurations of the multi-stable mechanism 102, each corresponding to a locked state or an unlocked state of the electronic lock 100. The multi-stable mechanism 102 is a mechanical structure in the electronic lock 100 that has at least two stable configurations, wherein energy is consumed to move from one stable configuration to another, but no additional energy is consumed to maintain one of the stable configurations mechanically. For example, if the multi-stable mechanism 102 is not already at an intended state, the electronic lock 100 switches between states of the multi-stable mechanism 102 by actuating a mechanical driver coupled to the multi-stable mechanism 102. For example, the mechanical driver can rotate a rotor that is part of the multi-stable mechanism 102 when switching between the stable configurations. In this example, different rotational positions of the rotor can correspond to different stable configurations where the rotor is held in place without external energy. Different rotational positions of the rotor can also correspond to a locked state or an unlocked state, depending on whether a short span (e.g., a slot or a short radius portion) in the rotor is aligned with a locking pin for the locking pin to retract.

The mechanical coupling of the multi-stable mechanism 102 at the locked state to at least a component of the barrier fixation assembly 106 prevents an external force from disengaging the barrier fixation assembly 106 from the barrier 104, which serves to prevent access to a restricted space. Similarly, the mechanical coupling (or lack thereof) of the multi-stable mechanism 102 at the unlocked state to at least a component of the barrier fixation assembly 106 can enable an external force to disengage an interlocking component that directly or indirectly fixates the barrier 104.

In some embodiments, the electronic lock 100 includes a power supply 114. The power supply 114 can be coupled to the electronic circuitry 108 and/or an actuation driver 112. The power supply 114 can be a battery, a capacitor coupled to an energy harvesting mechanism, a renewable energy source (e.g., solar, piezoelectric, human powered generator), a wireless charger coupled to an energy storage device, a power interface to an external power source, or any combination thereof.

Figure 2A:
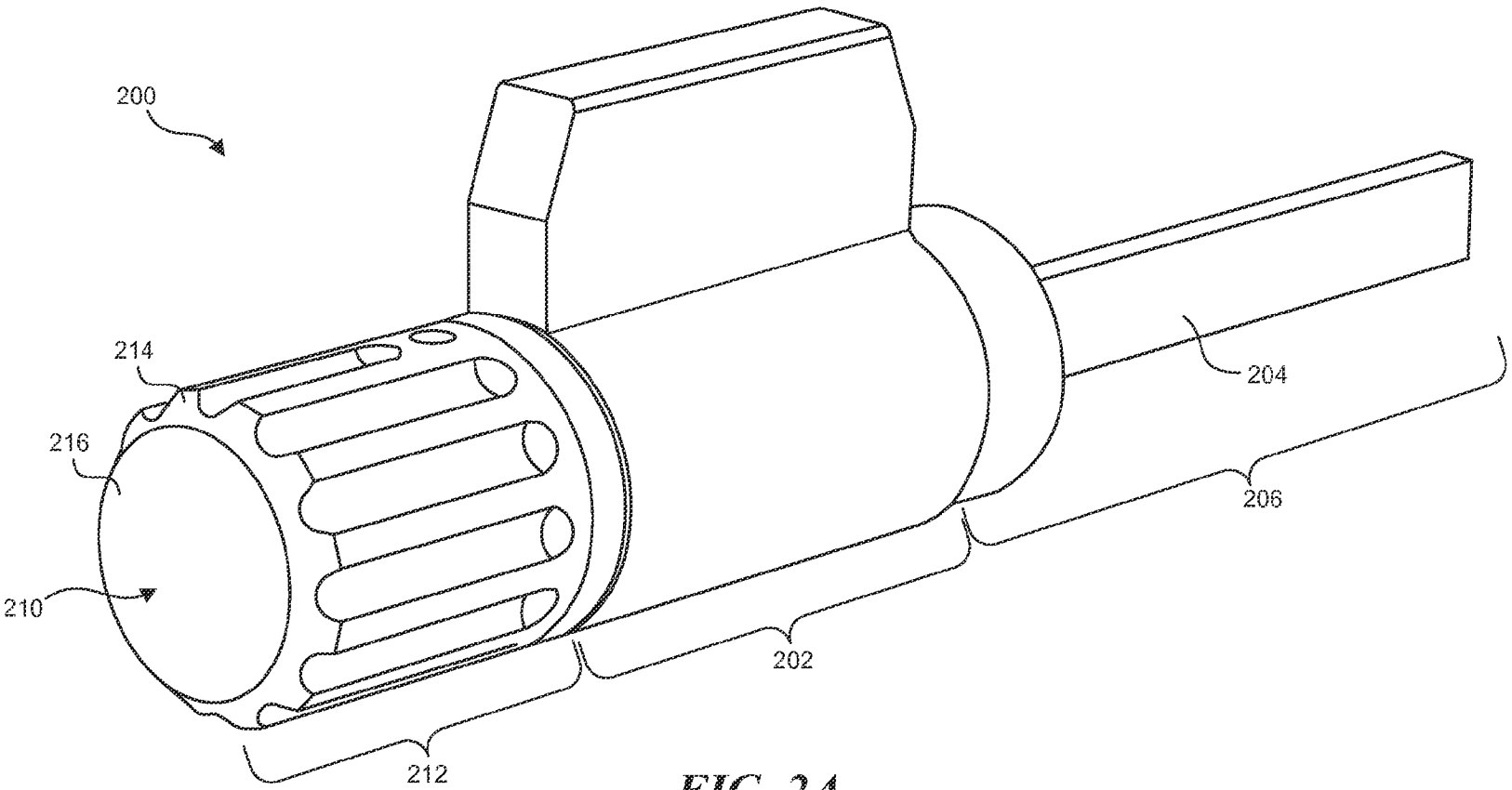
FIG. 2A is a perspective view of an electronic lock cylinder, in accordance with various embodiments.

FIG. 2A is a perspective view of an embodiment of an electronic lock cylinder 200. The electronic lock cylinder 200 can include a housing shell 202 that may fit into a conventional lock (e.g., a door lock). The electronic lock cylinder 200 can include a tail section 206 with a tailpiece 204 that interlocks with conventional boltwork hardware. In some embodiments, the tailpiece 204 can be coupled with other standard or proprietary barrier fixation assembly.

Figure 2B:
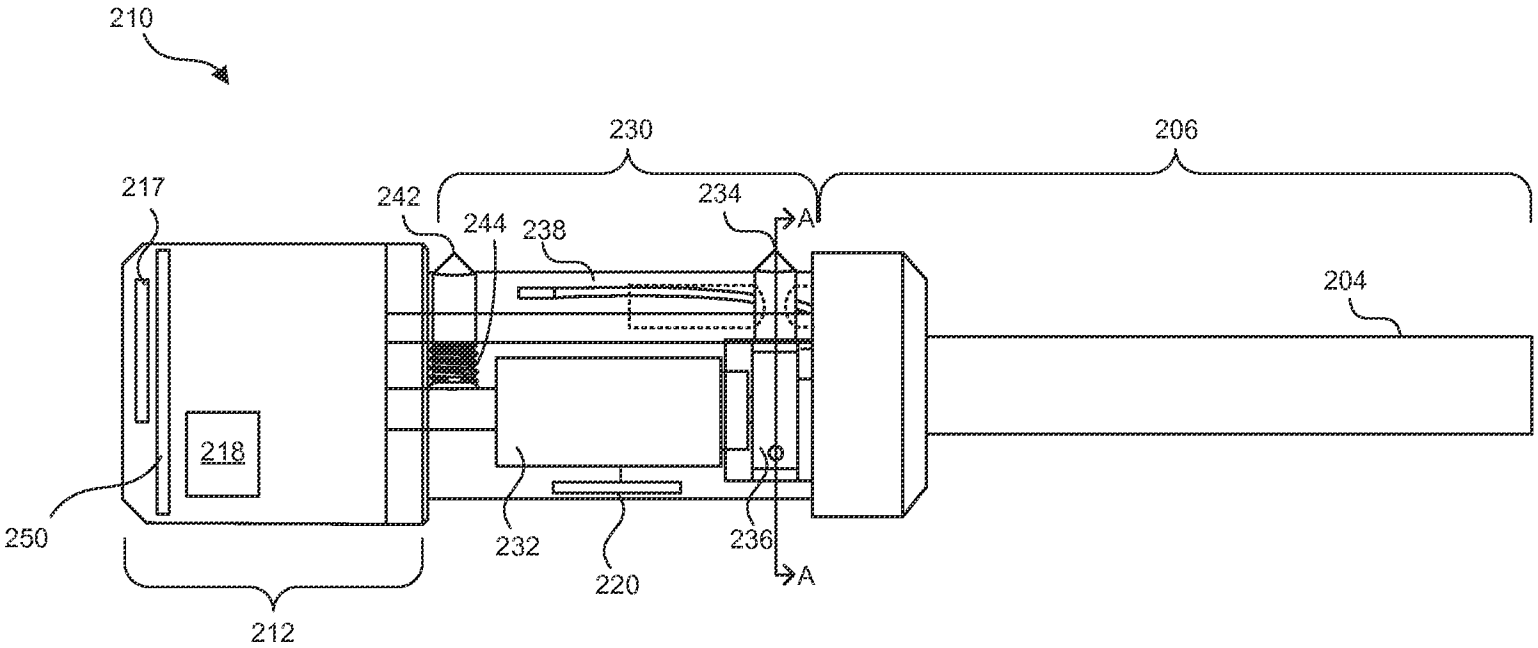
FIG. 2B is a plan side view of the electronic lock cylinder of FIG. 2A without the housing shell.

The electronic lock cylinder 200 also includes a plug assembly 210 (shown by an arrow in FIG. 2A pointing at a structure that includes both the front portion 212 and a back portion 230 shown in FIG. 2B). The back portion 230 can fit within the housing shell 202. FIG. 2A illustrates a front portion 212 of the plug assembly 210. The front portion 212 is exposed from the housing shell 202. The front portion 212 may be wider, the same size, or smaller than the body of the housing shell 202. In some embodiments, the front portion 212 is a detachable component. For example, when the electronic lock cylinder 200 is fitted into a standard hole in a door lock, the front portion 212 can protrude from an exposed surface of the door lock. The front portion 212 can be used as a knob to rotate the plug assembly 210 (e.g., causing a rotation of the tailpiece 204 and thereby any boltwork hardware attached to the tailpiece 204), during which rotation of the housing shell 202 remains stationary. The front portion 212 can include a patterned surface 214 (e.g., grooved or knurled) to facilitate the ergonomic property of the knob. For example, the patterned surface 214 can improve grip by having a rubbery and/or soft exterior layer and/or grooved patterns. Optionally, an attachable cover can also be installed over the patterned surface 214. For example, the attachable cover can use the patterned surface 214 to help secure the attachable cover and/or other means of attachment (e.g., mechanical fastener). Such attachable cover could provide a lever or other protruding structure, to facilitate rotation of the front portion 212 by an external force, and to provide the opportunity for an end-user to select an attachable cover with a style and/or finish that is aesthetically pleasing in the context of other nearby hardware.

The front portion 212 can further be used to display information to a user requesting entry. Optionally, the front portion 212 can include one or more output devices 216, such as a text/graphics display and/or one or more LEDs (e.g., to notify the user of the status of authenticating the user and/or whether the electronic lock cylinder 200 is in a locked or unlocked state), a speaker to provide an audible feedback (e.g., a beep when the electronic lock cylinder 200 unlocks or locks) or a haptic feedback device (e.g., a special vibration sequence to denote that an extended data transfer is complete). The output device 216 can display other status information, including electric charge left in a power source of the electronic lock cylinder 200 or time left until the power source is recharged (e.g., via a renewable energy charger or a wireless charging device).

FIG. 2B is a plan side view of the electronic lock cylinder 200 of FIG. 2A without the housing shell 202. FIG. 2B illustrates the front portion 212 without the patterned surface 214 and a back portion 230 of the plug assembly 210 without the housing shell 202. At least some components are shown to be transparent, translucent (e.g., see through), or left out of the drawing for convenience of illustration.

The front portion 212 can include one or more antennae 217. The one or more antenna(e) 217 can serve various functions. For example, the antenna(e) 217 may be used to exchange data between the electronic lock cylinder 200 and a mobile device, such as a mobile device of a user requesting entry through a barrier protected by the electronic lock cylinder 200. The data, for example, can be an electronic key, audit trail collection, or firmware updates for the electronic cylinder 200. For another example, the antenna(e) 217 can be used to receive wireless power to recharge the power source and/or to actuate mechanical components within the electronic lock cylinder 200. The antennae 217 can be disposed proximate or adjacent to an exterior of the electronic lock cylinder 200.

In some embodiments, the front portion 212 also includes a power source 218. In some embodiments, the back portion 230 includes the power source 218. The power source 218 can be used to power an electronic circuitry 220 that provides the logic necessary to process external signals to authenticate a user and to command unlocking of the electronic lock cylinder 200 based on the external signals. The electronic circuitry 220 can be disposed in the back portion 230 of the electronic lock cylinder 200.

The back portion 230 of the plug assembly 210 includes at least an actuation driver 232 (e.g., a motor or other circuit controlled actuator) controlled by the electronic circuitry 220. For example, the actuation driver 232 can be a DC motor or a solenoid actuator. The back portion 230 can also include a locking pin 234. The locking pin 234 is able to extend or retract depending on the configuration (e.g., angular orientation or positional orientation) of a rotor 236. The rotor 236 can be the multi-stable mechanism 102 of FIG. 1. As defined above, "extending" can refer to any movement of the locking pin 234 toward a notch 252 in the housing shell 202 shown in FIG. 2C. As defined above, "retracting" can refer to shifting the locking pin 234 away from the notch 252 in the housing shell 202. When extended, the locking pin 234 can fit into the notch 252 in the housing shell 202. When the rotor 236 is in a configuration that prevents the locking pin 234 from retracting, the locking pin 234 interlocks with the housing shell 202 and thus prevents the rotation of the plug assembly 210.

In some embodiments, the locking pin 234 is held in the extended state by a locking pin spring 238. The locking pin spring 238 is any mechanism that provides a force to push or pull the locking pin 234 back toward the notch 252. For example, the locking pin spring 238 can be a torsion spring, a coil spring or a magnet configured to oppose another magnet on the locking pin 234. For example, the coil spring can be positioned between the locking pin 234 and the rotor 236. In another example, the torsion spring can be inserted into a hole in the locking pin 234. A torsion spring is advantageous when vertical space is limited as illustrated in FIG. 2B. A coil spring is advantageous where horizontal space is limited (not shown).

Optionally, the back portion 230 can also include a centering pin 242 and a corresponding centering pin spring 244. The centering pin spring 244 can be a torsion spring or a coil spring (e.g., similar to the locking pin spring 238). The centering pin 242 can also fit in a notch (not shown) in the housing shell 202 different from the notch for the locking pin 234. The centering pin 242 may have several benefits. For example, the centering pin 242 can maintain the plug assembly 210 in an angular position where locking pin 234 can be fully extended, such that the locking pin 234 does not impinge upon the rotation of rotor 236. This is advantageous to eliminate friction that inhibits the movement of the rotor 236 in order to reduce the power requirement to move the rotor 236. The centering pin 242 can also act in a manner that serves as a "detent" to provide feedback to the user, indicating the angular position of the plug. In some embodiments, additional notches in the housing shell 202 may couple with additional detents.

In some embodiments, the front portion 212, the back portion 230, the interface between the front portion 212 and the back portion 230, or any combination thereof can include an electromagnetic field (EMF) shielding, such as a shielding 250. The shielding 250 may be high permeability shielding. The shielding 250 may be disposed adjacent to the antennae 217 toward the back portion 230. In some embodiments, the shielding 250 can be integrated within a wall of the plug assembly 210. For example, the rotor 236 can have a multi-stable property due to the placement of one or more magnets in the rotor 236 (see FIG. 3). The shielding 250 can be used to prevent tampering of the locking mechanism provided by the rotor 236. The shielding 250 can also be used to prevent electromagnetic field interference or coupling with other electrically conductive components (e.g., the motor) in the electronic lock cylinder 200.

In some embodiments, less than or equal to a quarter rotation of the rotor 236 changes the rotor 236 between a locked configuration and an unlocked configuration. This feature advantageously reduces the energy requirement of the actuation driver 232.

In various embodiments, the back portion 230 can also include the electronic circuitry 220 to communicate with the antenna(e) in the front portion 212 and authenticate an electronic key received thereon and to control the actuation driver 232. For example, the electronic circuitry can be the electronic circuitry 108 of FIG. 1. The back portion 230 can further include a power source.

Figure 2C:
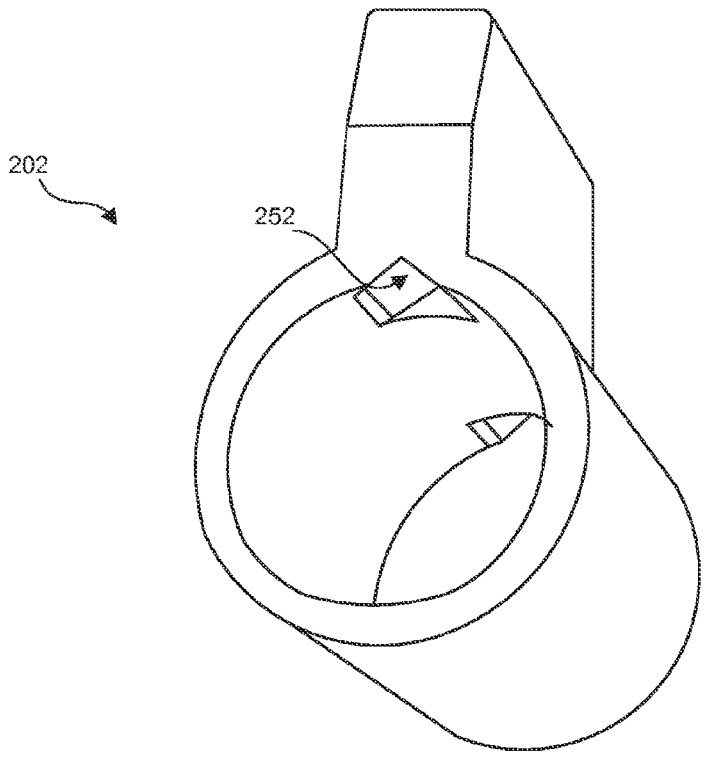
FIG. 2C is a perspective view of the housing shell of the electronic lock cylinder of FIG. 2A.
Figure 2D:
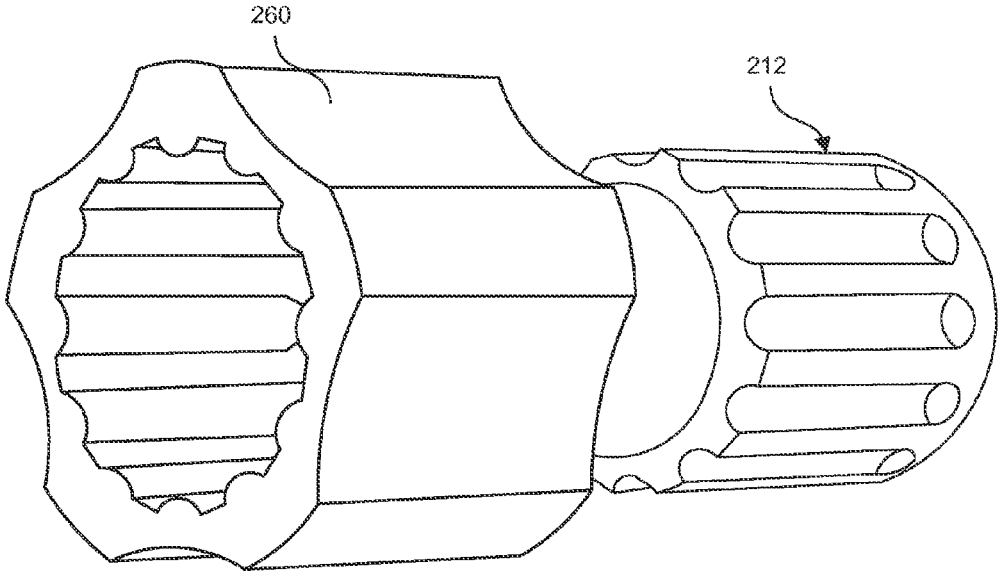
FIG. 2D is a perspective view of an attachable cover for the front portion of the electronic lock cylinder of FIG. 2A before the attachable cover is fitted onto the electronic lock cylinder.
Figure 2E:
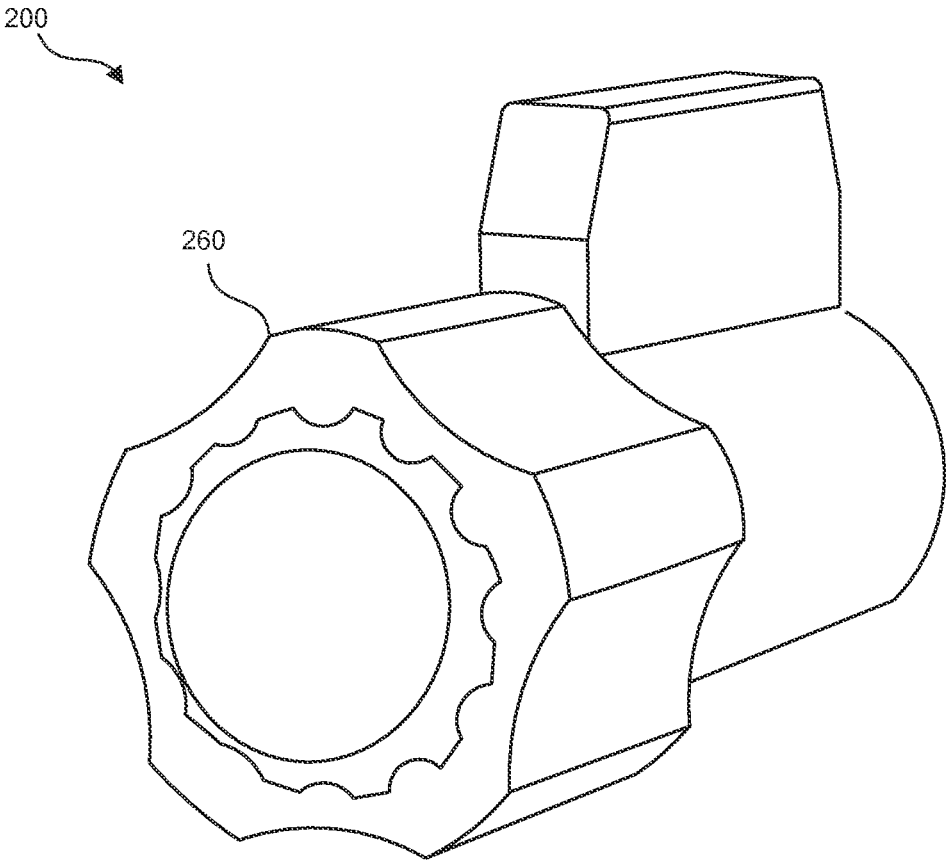
FIG. 2E is a perspective view of the attachable cover for the front portion of the electronic lock cylinder of FIG. 2A after it is fitted onto the electronic lock cylinder.

FIG. 2C is a perspective view of the housing shell 202 of the electronic lock cylinder 200 of FIG. 2A. FIG. 2D is a perspective view of an attachable cover 260 for the front portion 212 of the electronic lock cylinder 200 of FIG. 2A before it is fitted onto the electronic lock cylinder 200. FIG. 2E is a perspective view of the attachable cover 260 for the front portion 212 of the electronic lock cylinder 200 of FIG. 2A after it is fitted onto the electronic lock cylinder 200.

Figure 3:
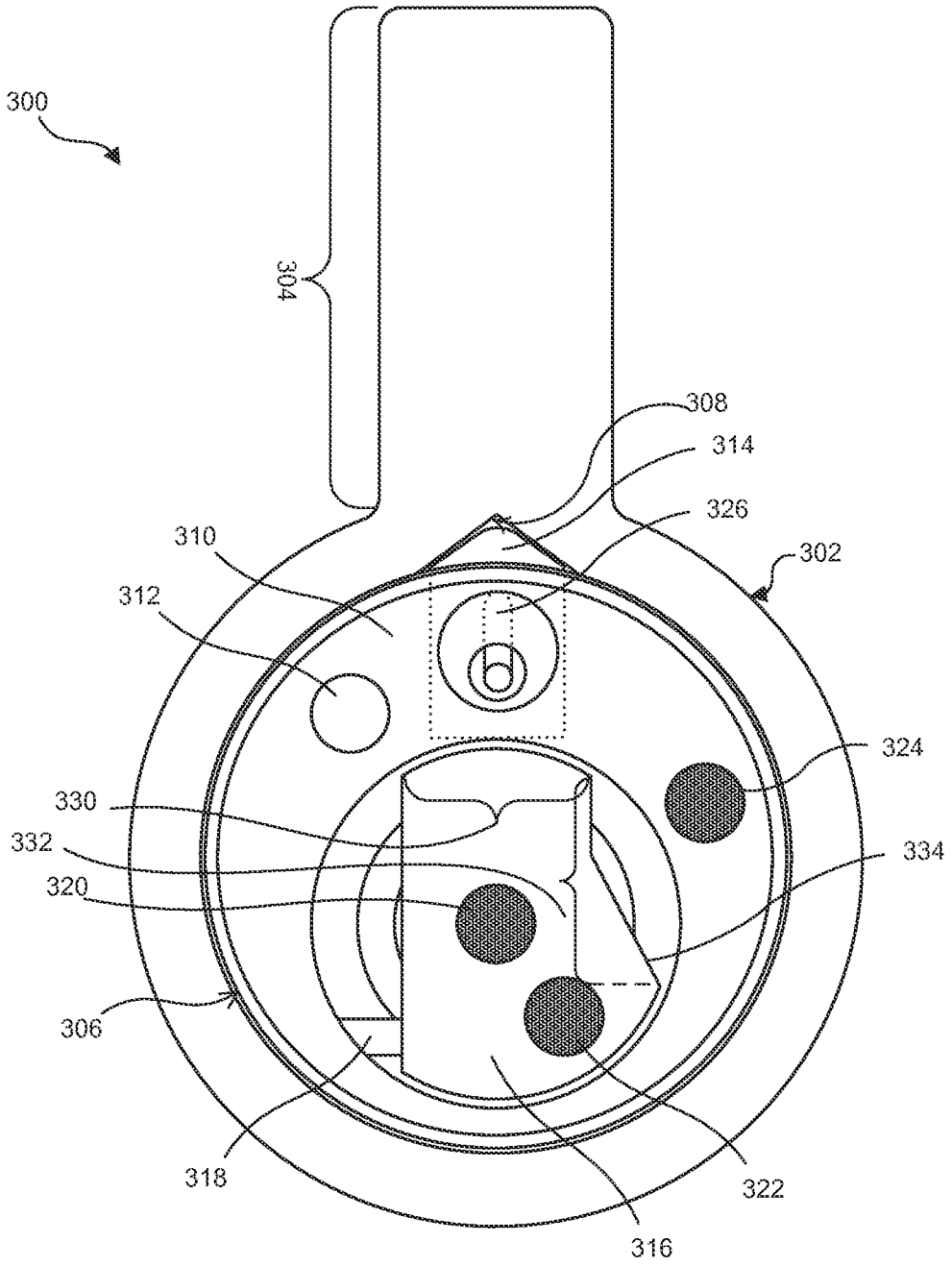
FIG. 3 is a cross-sectional diagram illustrating an electronic lock cylinder, consistent with the electronic lock cylinder of FIG. 2B along line A-A, according to at least one embodiment.

FIG. 3 is a cross-sectional diagram illustrating an electronic lock cylinder 300, consistent with the electronic lock cylinder 200 of FIG. 2B along line A-A, according to at least one embodiment. The electronic lock cylinder 300 includes a housing shell 302, such as the housing shell 202, that cylindrically wraps around the back portion 230 of plug assembly 306, such as the plug assembly 210. The plug assembly 306 can include a plug body 310 that is substantially cylindrical to facilitate rotation within the housing shell 302. The plug body has empty compartments to place components and interconnects. In some embodiments, the plug body 310 can be a cylindrical shell with various cutouts for the components of the plug assembly 306. For example, a hole 312 that runs along the cylindrical axis of the plug assembly 306 can be used for running wires through the plug body 310.

The housing shell 302 can include an extension that enables the electronic cylinder 300 to mimic the shape of conventional mechanical lock cylinders that are designed to be replaceable, in order to assure physical compatibility between the electronic lock cylinder 300 and such replaceable mechanical lock cylinders. For example, the housing shell 302 can include a "bible" 304 that radially projects from a plug assembly 306. Such a bible in a conventional pin tumbler cylinder holds pins and springs. The shape of the bible is customized differently by various lock manufacturers. As a second example, the housing shell 302 can be shaped in a "figure-eight" format so that the electronic lock cylinder 300 can be interchangeable with mechanical lock cylinders marketed as "interchangeable core" lock cylinders.

A notch 308 can be disposed on the cylindrical interior of the housing shell 302, as shown in FIG. 3. In some embodiments, the notch 308 is a substantially conical cavity. In those embodiments, a locking pin 314, such as the locking pin 234, can have a conical tip. In some embodiments, the notch 308 is a prism-shape cavity. In those embodiments, the locking pin 314 can have a prism-shape tip, such as a chiseled tip. In some embodiments, at least some of the edges of the tip of the locking pin 314 are rounded. In other embodiments, at least some of the edges of the tip are straight. The prism-shape tip and the prism-shape cavity are advantageous because of increased surface contact between the locking pin and the notch 308 and therefore more resistant to deterioration (e.g., wear and tear).

In some embodiments, where a lock has been designed without regard to easy replacement of the cylinder, the body of the lock itself, or another component within the lock, can function as the housing for a cylinder that lacks a housing shell. In such embodiments, the notch 308 can be embedded in the body of the lock or a component that will remain fixed relative to the cylinder when the cylinder is turned.

The plug assembly 306 can include at least a rotor 316, such as the rotor 236, a rotor stop 318, a rotor axle 320, a rotor magnet 322, a body magnet 324, the locking pin 314, and a locking pin spring 326, such as the locking pin spring 238. The rotor 316 is rotatably secured to the plug body 310 via the rotor axle 320. This enables independent rotation of the rotor 316 relative to the plug assembly 306. The rotor stop 318 is a structure fixated to the plug body 310 that limits the rotational movement of the rotor 316 around the rotor axle 320. Whenever the rotor 316 hits the rotor stop 318, the rotor 316 cannot rotate any further in the same direction. The rotor stop 318 can be used to align the rotor 316 at the intended stable configuration.

The locking pin 314 sits in a pin hole through the plug body 310. At an extended state, the locking pin 314 fits into the notch 308 of the housing shell 302. The locking pin spring 326 pushes the locking pin 314 upwards towards the notch 308 such that the weight of the locking pin 314 does not press upon the rotor 316 and subsequently impede movement of the rotor 316.

In at least one embodiment, the rotor magnet 322 and the body magnet 324 have the same polarity aligned towards each other. Accordingly, the magnets repel from each other forcing the rotor 316 to rotate until one side of the rotor 316 reaches the rotor stop 318. The direction of how the rotor 316 spins depends on the radial positioning of the body magnet 324. For example, if the body magnet 324 is positioned radially clockwise from the radius of the rotor 316 intersecting the rotor magnet 322, then the rotor 316 would rotate counterclockwise. If the body magnet 324 is positioned radially counterclockwise from the radius intersecting the rotor magnet 322, then the rotor 316 would rotate clockwise.

As shown, the rotor 316 has at least a long span 330 (with a longer radius) and a short span 332 (with shorter radius or radii). The long span 330 is long enough to cover a portion of the pin hole in the plug body 310 such that the locking pin 314 cannot retract. The short span 332 is short enough to expose the pin hole in the plug body 310 such that the locking pin 314 can retract. The short span 332 can include a slanted surface 334 (i.e., where the tangent to the slanted surface 334 is not perpendicular to the direction of travel of the locking pin 314, so as to translate the downward force of the locking pin 314 into a rotational force of the rotor 316).

Figures 4A, 4B, 4C:
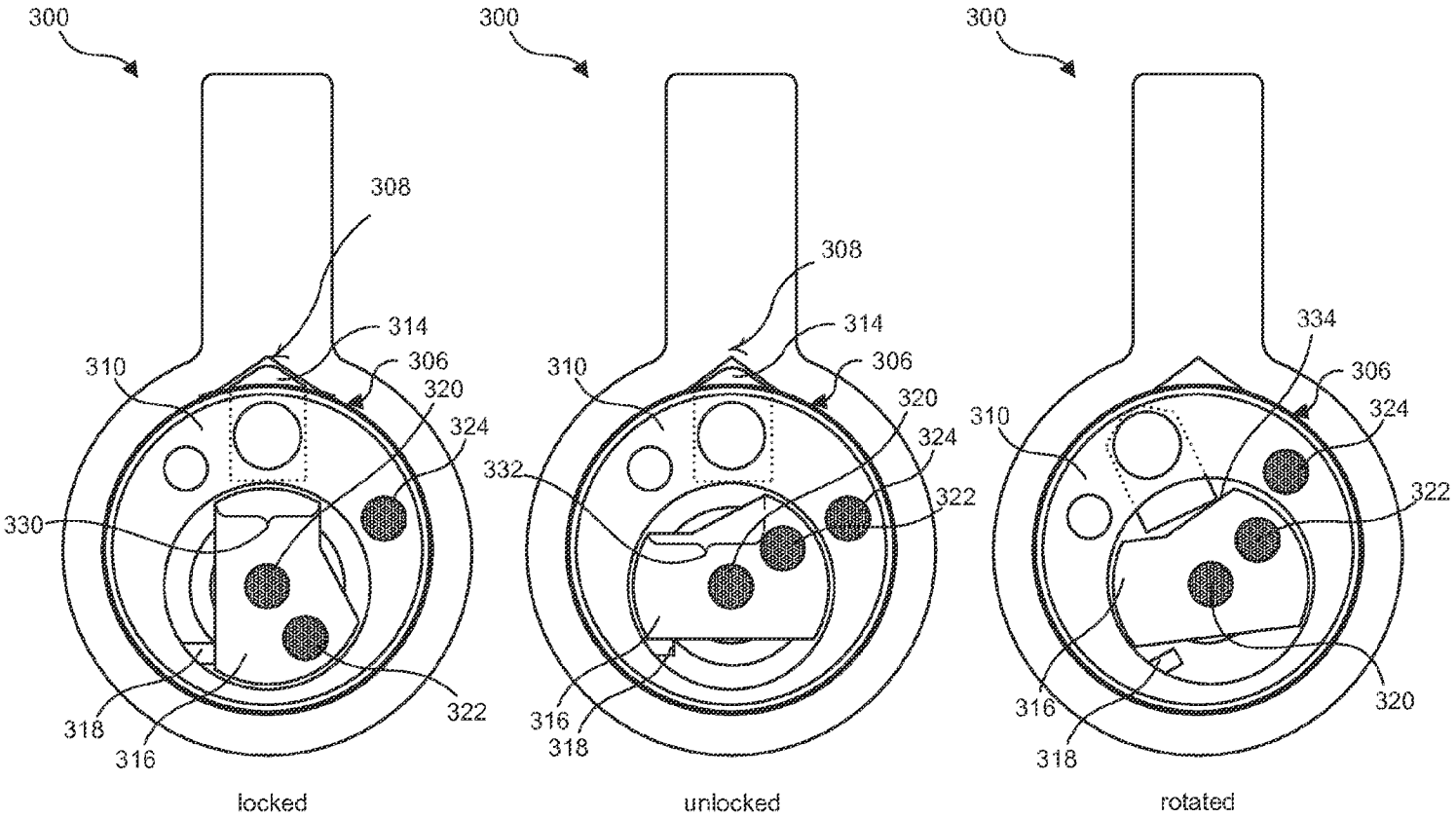
FIG. 4A is a cross-sectional diagram illustrating the electronic lock cylinder of FIG. 3 in a locked state.
FIG. 4B is a cross-sectional diagram illustrating the electronic lock cylinder of FIG. 3 in an unlocked state.
FIG. 4C is a cross-sectional diagram illustrating the electronic lock cylinder of FIG. 3 when the plug assembly therein is being rotated.

FIG. 4A is a cross-sectional diagram illustrating the electronic lock cylinder 300 of FIG. 3 in a locked state. In the locked state, the rotor 316 is at a stable configuration. The rotor axle 320 secures the rotor 316 to the plug body 310 such that the rotor 316 can rotate. Here, the body magnet 324 is positioned radially counterclockwise from the radius intersecting the rotor magnet 322. Hence, the rotor 316 is pushed clockwise against the rotor stop 318. The opposing forces from the magnets and the normal force of the rotor stop 318 keep the rotor 316 at the locked state.

This stable configuration of the rotor 316 is considered "the locked state" because the long span 330 of the rotor 316 prevents the locking pin 314 from retracting into the pin hole in the plug body 310. If an external force (e.g., from a user) attempts to rotate the plug assembly 306, the ramp shape of the notch 308 would push the locking pin 314 downwards (against the locking pin spring 326). However, the locking pin 314 would push against the outer edge wall of the long span 330 of the rotor 316 and would thus be unable to retract.

FIG. 4B is a cross-sectional diagram illustrating the electronic lock cylinder 300 of FIG. 3 in an unlocked state. In the unlocked state, the rotor 316 is at a stable configuration. Again, the rotor axle 320 secures the rotor 316 such that it can only move via rotation. Here, the body magnet 324 is positioned radially clockwise from the radius intersecting the rotor magnet 322. Hence, the rotor 316 is pushed counterclockwise against the rotor stop 318. The opposing forces from the magnets and the normal force of the rotor stop 318 keep the rotor 316 at the unlocked state. This stable configuration of the rotor 316 is considered "the unlocked state" because the short span 332 of the rotor 316 enables the locking pin 314 to retract into the pin hole in the plug body 310 toward the center of the rotor. In embodiments with the locking pin spring 238, the locking pin spring 238 can exert a force pulling or pushing the locking pin 314 towards the notch 308 in both the unlocked state of FIG. 4B and the locked state of FIG. 4A.

FIG. 4C is a cross-sectional diagram illustrating the electronic lock cylinder 300 of FIG. 3 when the plug assembly 306 therein is being rotated. When a force attempts to rotate the plug assembly 306, the ramp shape (e.g., a conical cavity or a prism cavity) of the notch 308 pushes the locking pin 314 downward against the slanted surface 334 of the rotor 316 in the short span 332. The force on the slanted surface 334 provides a torque to spin the rotor 316 clockwise out of its stable configuration of the unlocked state. The short span 332 (e.g., after a slight rotation by the torque force) gives enough clearance for the locking pin 314 to fully retract from the notch 308 of the housing shell 302, thus allowing the plug assembly 306 to freely rotate.

The rotation of the plug assembly 306 may be coupled to a rotation of the tailpiece 204 allowing the tailpiece 204 to disengage another interlocking component of a barrier fixation assembly. The torque that spins the rotor 316 clockwise spins the rotor 316 such that the body magnet 324 is positioned radially counterclockwise from the radius intersecting the rotor magnet 322. Because of that, the magnets repel each other and spin the rotor 316 further until it reaches the locked state as in FIG. 4A. That is, when a user turns the plug assembly 306 (e.g., via turning the front portion 212 of FIG. 2A) to a position where the locking pin 314 can extend back into the notch 314, the rotor 316 will continue rotating clockwise until it reaches the locked state as in FIG. 4A. This mechanism is advantageous because the electronic lock cylinder 300 can re-lock without needing a user to remember to re-lock it. This also acts as a security feature such that each individual authentication only allows a single opportunity to turn the plug assembly 306 (to unlock) before the electronic lock cylinder 300 relocks again.

Figure 5:
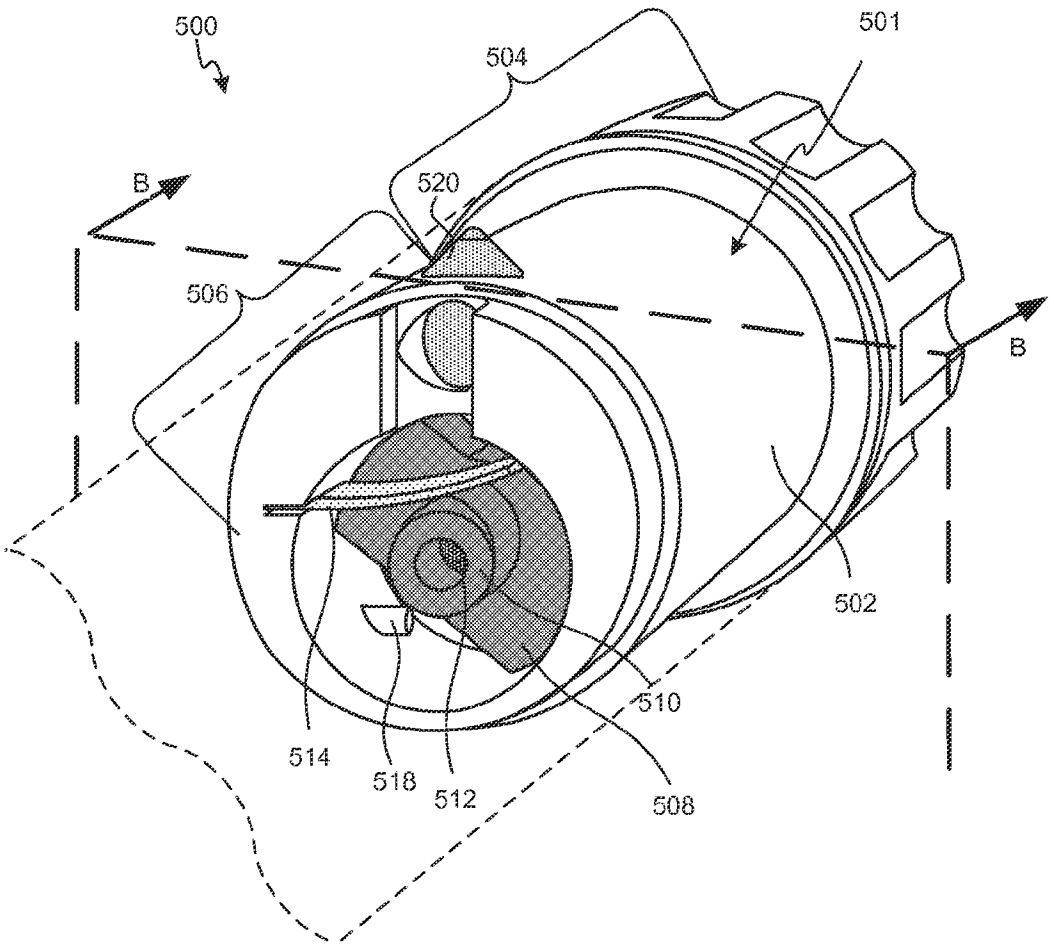
FIG. 5 is a rear isometric view of an electronic lock cylinder, according to various embodiments.

FIG. 5 is a rear isometric view of a plug assembly 501 for an electronic lock cylinder 500, according to various embodiments. The electronic lock cylinder 500 can be the electronic lock cylinder 200 of FIG. 2A. Similar to the electronic lock cylinder 200, the electronic lock cylinder 500 can include a housing shell (not shown). The plug assembly 501 includes a plug body 502. The plug assembly 501 and the plug body 502 can be divided into a front portion 504 and a back portion 506. The front portion 504 can be the front portion 212 of FIG. 2A. The back portion 506 includes an actuation driver (not shown), such as the actuation driver 232 of FIG. 2A, coupled a rotor 508 to drive the rotor 508. The rotor 508 can be the rotor 236 of FIG. 2.

A cam lobe 510 is attached to the rotor 508 such that rotating the cam lobe 510 causes a rotation of the rotor 508 as well. Both the rotor 508 and the cam lobe 510 can be coupled to a rotor axle 512 and rotate along the rotor axle 512. For example, the rotor axle 512 can be rotatably coupled to the plug body 502 enabling the rotor 508 and the cam lobe 510 to rotate.

A flat spring 514 can be disposed in the plug body 502 in contact with the cam lobe 510. The flat spring 514 extends from and is attached to the plug body 502. The flat spring 514, when bent from a flat state, exerts a rotational force (e.g., torque) on the cam lobe 510. Within a first range of angles, the flat spring 514 can exert a clockwise rotational force. Within a second range of angles, and the flat spring 514 can exert a counterclockwise rotational force, where the first range and the second range do not overlap.

In some embodiments, the flat spring 514 is replaced with another tension producing mechanism. For example, the flat spring 514 can be replaced with a coil spring that pushes a mechanical tip against the cam lobe 510.

A rotor stop 518 may be coupled to the plug body 502. The rotor stop 518 limits the rotational movement of the rotor 508. Accordingly, the rotor 508 can have at least two stable configurations: one where a clockwise rotational force from the flat spring 514 pushes the rotor 508 against the rotor stop 518, and one where a counterclockwise rotational force from the flat spring 514 pushes the rotor 508 against the rotor stop 518.

Similar to the electronic lock cylinder 200, the plug assembly 501 includes a locking pin 520, such as the locking pin 234. The locking pin 520 can retract toward the center of the plug assembly 501 when a short span of the rotor 508 is positioned underneath. The locking pin 520 cannot retract when a long span of the rotor 508 is positioned underneath. The locking pin 520 can be similarly positioned in a notch of the housing shell such as the locking pin 314 of FIG. 3. The locking pin 520 can also be similarly coupled to a locking pin spring (not shown), such as the locking pin spring 238.

Figure 6A:
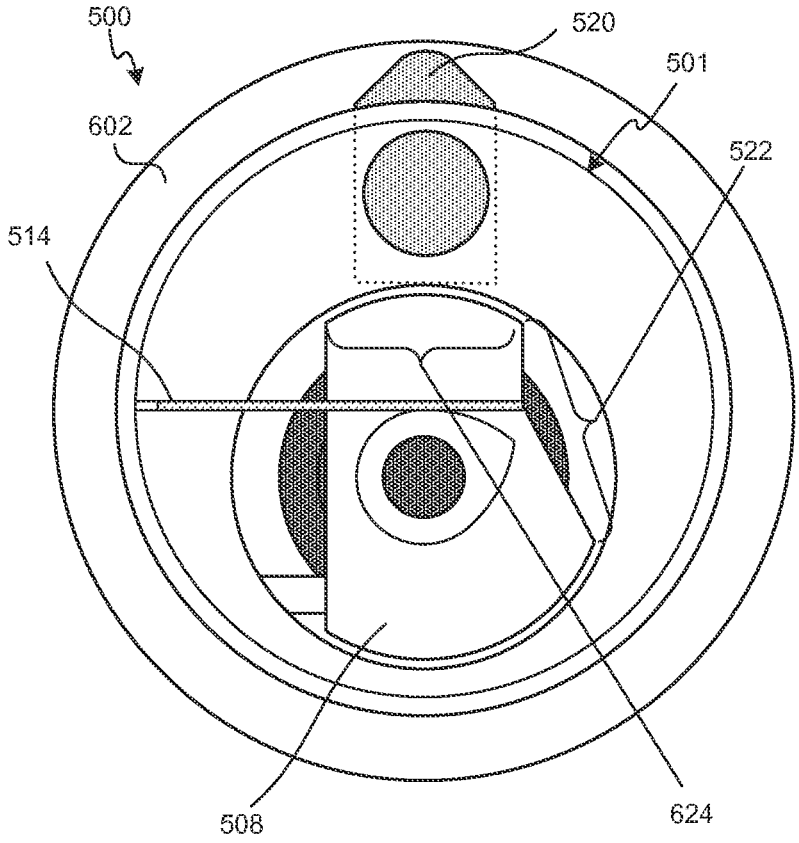
FIG. 6A is a cross-sectional diagram illustrating the electronic lock cylinder of FIG. 5 in a locked state along line B-B.

FIG. 6A is a cross-sectional diagram illustrating the electronic lock cylinder 500 of FIG. 5 in a locked state along line B-B. The electronic lock cylinder 500 is shown with a housing shell 602 around the plug assembly 501. In the locked state, the flat spring 514 exerts a slight clockwise rotational force to the rotor 508. However, the rotor stop 518 prevents any actual rotational movement and provides an equal and opposite normal force against the rotational force from the flat spring 514. In this stable configuration, the long span 624 of the rotor 508 is positioned underneath the locking pin 520, thereby preventing the locking pin 520 from retracting.

Figure 6C:
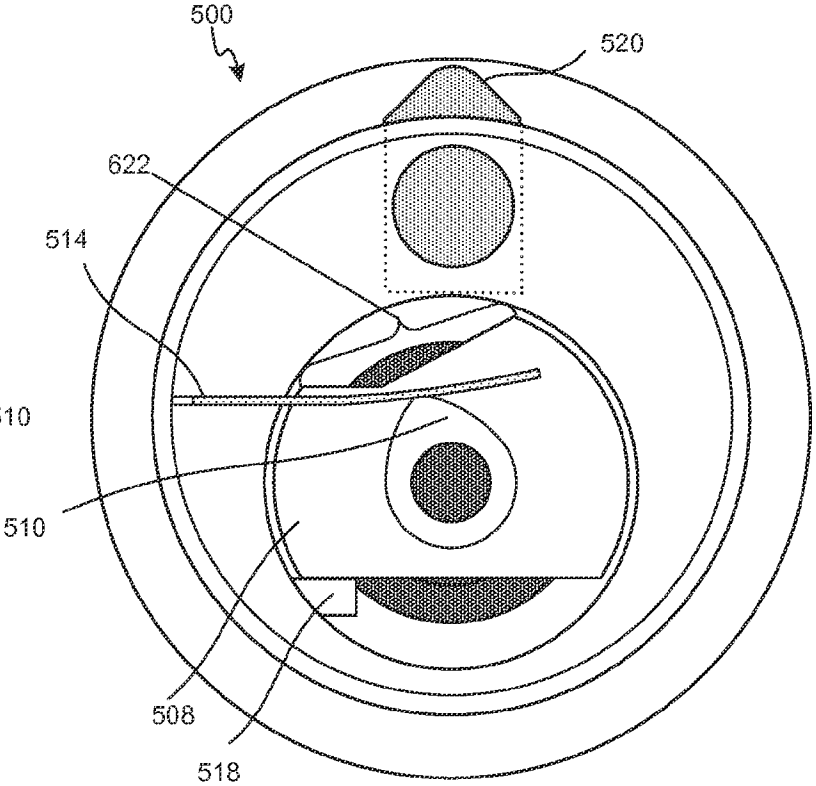
FIG. 6C is a cross-sectional diagram illustrating the electronic lock cylinder of FIG. 5 in an unlocked state along line B-B.
Figure 6B:
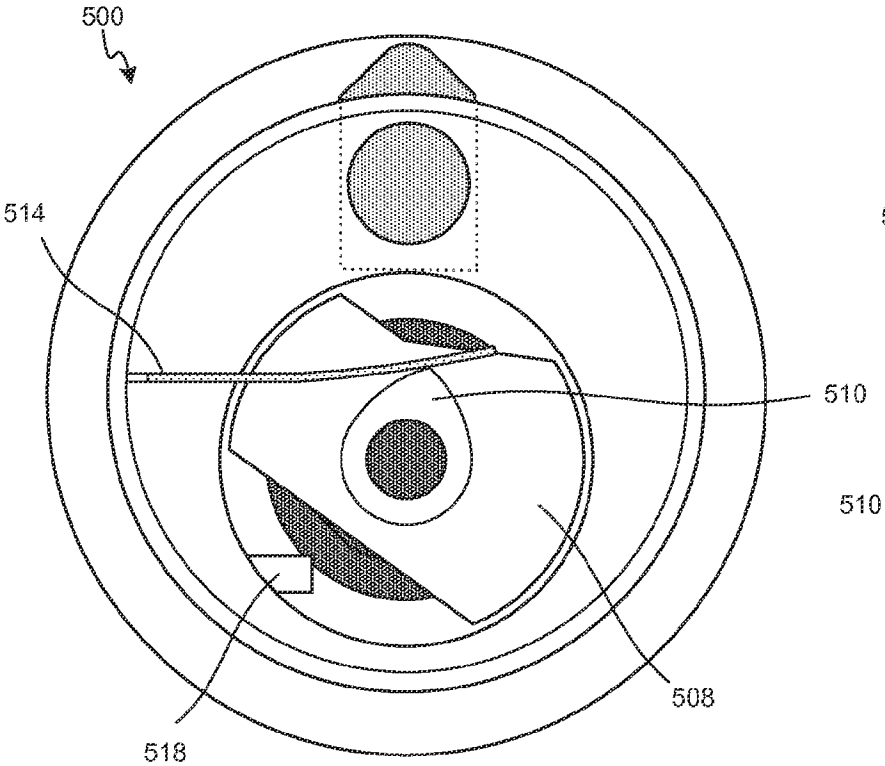
FIG. 6B is a cross-sectional diagram illustrating the electronic lock cylinder of FIG. 5 along line B-B while the rotor is turning between stable configurations.

FIG. 6B is a cross-sectional diagram illustrating the electronic lock cylinder 500 of FIG. 5 along line B-B while the rotor 508 is turning between stable configurations. When the rotor 508 is not pushing against the rotor stop 518 and the actuation driver is turned off, the flat spring 514 exerts a rotational force on the rotor 508 and thereby rotating the rotor 508. In FIG. 6B, the tip of the cam lobe 510 points away from the base side of the flat spring 514 and thus the flat spring 514 exerts a clockwise force. The clockwise force would return the rotor 508 to the locked state absent any intervening force applied by the actuation driver. This setup to return the rotor 508 to the locked state is at least advantageous because it improves security by avoiding a condition in which the rotor remains in an indeterminate state that is between two stable positions, as such condition would leave the electronic lock cylinder 500 subject to being bumped into an unlocked state by an external impact on the lock assembly.

FIG. 6C is a cross-sectional diagram illustrating the electronic lock cylinder 500 of FIG. 5 in an unlocked state along line B-B. When the actuation driver turns the rotor 508 counterclockwise against the clockwise force applied by the flat spring 514, the rotor 508 can reach the unlocked state. In the unlocked state, the tip of the cam lobe 510 points towards the base side of the flat spring 514. In this stable configuration, the flat spring 514 exerts a counterclockwise rotational force to the rotor 508. The rotor stop 518 prevents any actual rotational movement and provides an equal and opposite normal force against the rotational force from the flat spring 514. In this stable configuration, a short span 622 of the rotor 508 is positioned underneath the locking pin 520 and thereby enabling the locking pin 520 to retract.

The short span 622 can have a similar surface as the slanted surface 334 of FIG. 3. When the plug assembly 501 rotates within the housing shell 602, the normal force from the ramp surface of the notch in the housing shell 602 pushes against the slanted or curved tip of the locking pin 520 and thereby pushing the locking pin 520 downward towards the rotor 508. Downward force of the locking pin 520 in contact with the slanted surface of the short span 622 would cause the rotor 508 to rotate clockwise and eventually reach the locked state as shown in FIG. 6A. The rotation of the rotor 508 gives enough clearance for the locking pin 520 to avoid the housing shell 602.

Figure 7:
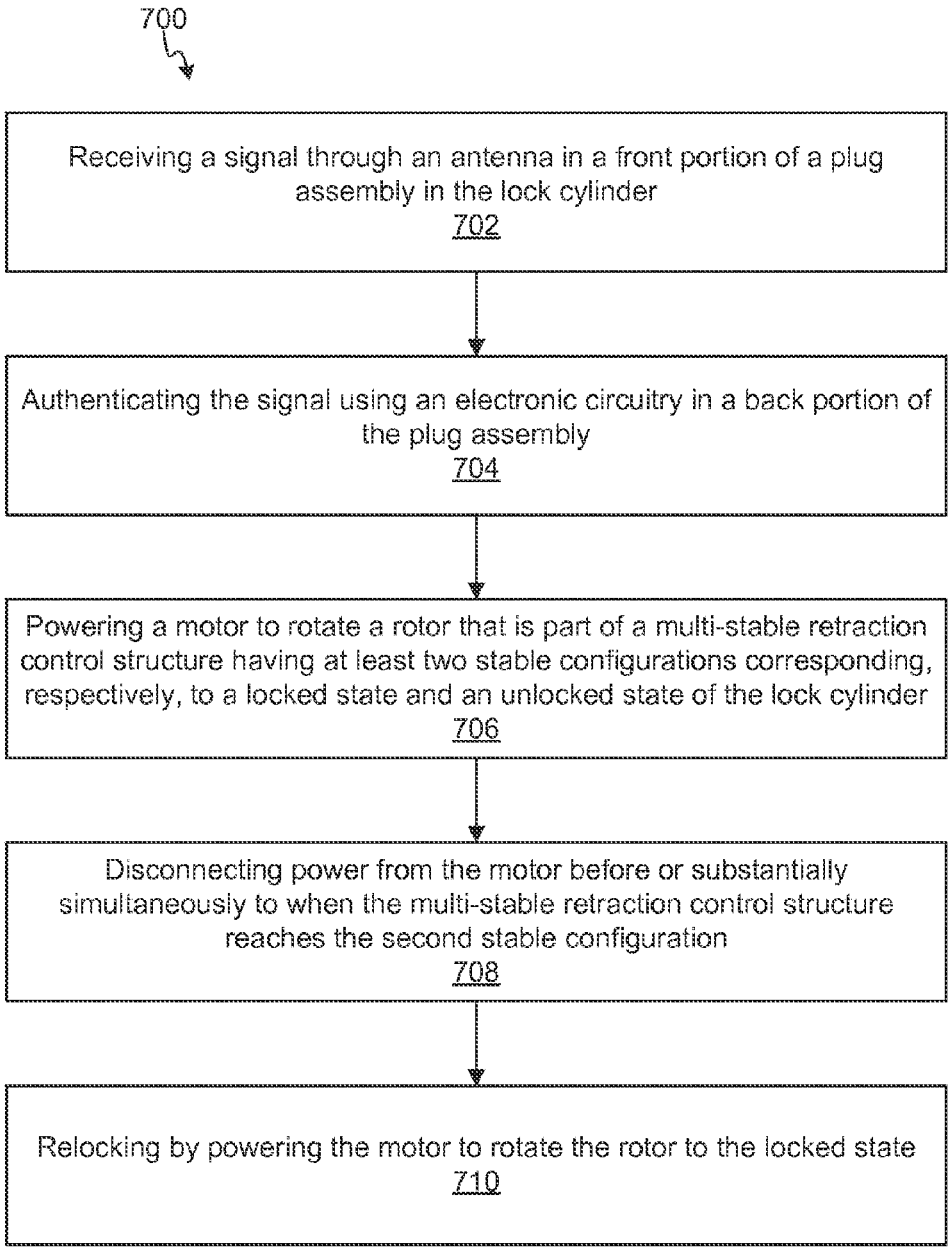
FIG. 7 is a flow chart of a method of operating a lock cylinder, in accordance with various embodiments.

FIG. 7 is a flow chart of a method 700 of operating a lock cylinder (e.g., the electronic lock cylinder 200, the electronic lock cylinder 300, or the electronic lock cylinder 500), in accordance with various embodiments. The method 700 includes step 702 of receiving a signal through an antenna in a front portion of a plug assembly in the lock cylinder, wherein the plug assembly is rotatably disposed in a housing shell. Then at step 704, an electronic circuitry in a back portion of the plug assembly authenticates the signal. At step 706, the electronic circuitry powers a motor to rotate a rotor that is part of a multi-stable refraction control structure (e.g., a locking pin blockage mechanism). For example, the multi-stable retraction control structure can be the rotor 316 of FIG. 3 or the rotor 508 of FIG. 5.

The multi-stable refraction control structure has at least two stable configurations corresponding to, respectively, a locked state and an unlocked state of the lock cylinder. The multi-stable retraction control structure can maintain the stable configurations without consuming energy. Rotating the rotor changes the multi-stable retraction control structure from a first stable configuration that prevents a locking pin from retracting into the plug assembly to a second stable configuration of the retraction control structure that enables the locking pin to retract. At step 708, the electronic circuitry disconnects power from the motor before, after, or substantially simultaneously to when the multi-stable retraction control structure reaches the second stable configuration.

Once the electronic lock cylinder is unlocked via step 706, the electronic lock cylinder can be re-locked, for example, by either an external force or in response to a command of the electronic circuitry. For example, the plug assembly can be configured such that a manual turning of the plug assembly (e.g., by a person) shifts the multi-stable retraction control structure from the second stable configuration back to the first stable configuration. Alternatively, at step 710, the electronic circuitry can relock by powering the motor to rotate the rotor to the locked state. Step 710 can be in response to receiving an external authenticated signal to relock. Step 710 can also be in response to determining that a charge of a power source of the motor is below a threshold level.

While processes or blocks are presented in a given order in FIG. 7, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. In addition, while processes or blocks are at times shown as being performed in series, these processes or blocks may instead be performed in parallel, or may be performed at different times.

Figure 8:
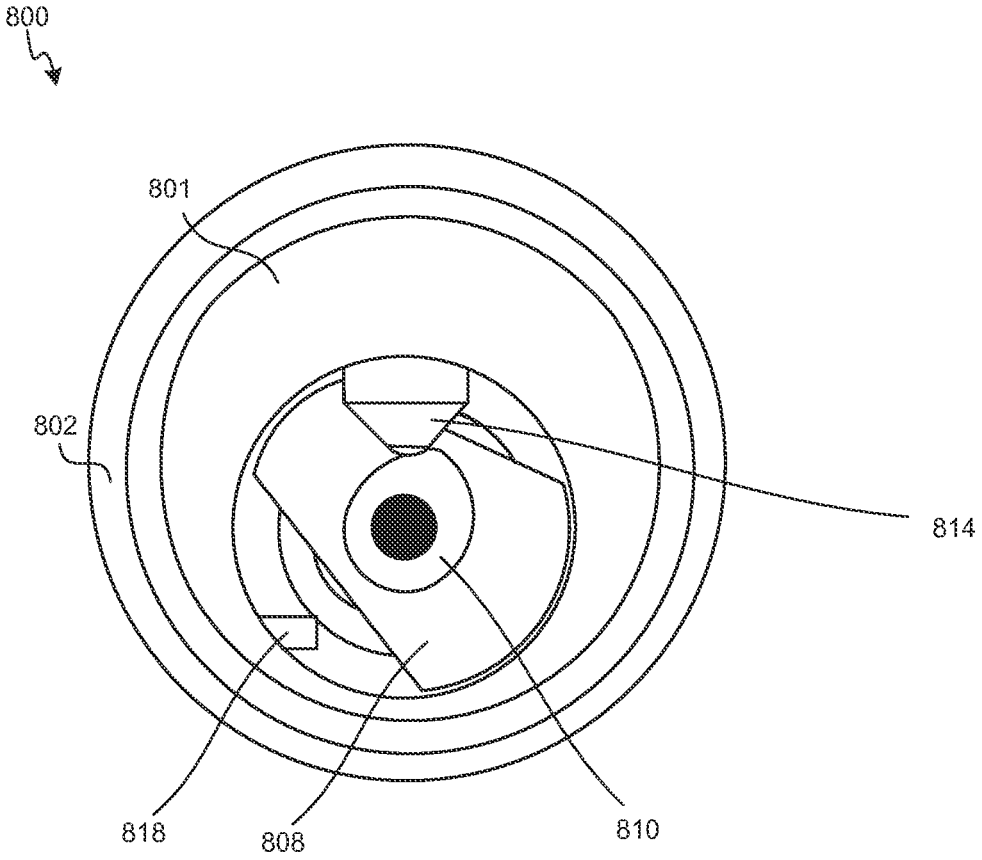
FIG. 8 is a cross-sectional diagram illustrating an electronic lock cylinder, consistent with the electronic lock cylinder of FIG. 2B along line A-A, according to at least one embodiment.

FIG. 8 is a cross-sectional diagram illustrating an electronic lock cylinder, 800, according to at least one embodiment. The electronic lock cylinder 800 includes a plug assembly 801 (e.g., the plug assembly 501 of FIG. 5), a housing shell 802 (e.g., the housing shell 602 of FIG. 6), a rotor 808 (e.g., the rotor 508 of FIG. 5), a cam lobe 810 (e.g., the cam lobe 510 of FIG. 5), and a rotor stop 818 (e.g., the rotor stop 518 of FIG. 5).

The electronic lock cylinder 800 is similar to the electronic lock cylinder 500 except that instead of pushing the cam lobe 510 with the flat spring 514, the electronic lock cylinder 100 includes a cam pin 814 for pushing against the cam lobe 810. The electronic lock cylinder 800 can also include one or more other components of FIG. 5 and FIGS. 6A-6C. For example, the electronic lock cylinder 800 can include the locking pin which is not shown in FIG. 8.

The cam pin 814 is a spring-loaded pin that exerts a small force against the cam lobe 810. In one stable configuration, the cam pin 814 pushes against the cam lobe 810, causing the cam lobe 810 to rotate, for example, in a clockwise direction until the rotor 808 pushes against a first surface (e.g. a side surface) of the rotor stop 818. In another stable configuration, the cam pin 814 pushes against the cam lobe 810 in a counterclockwise direction until the rotor 108 pushes against a second surface (e.g., a top surface) of the rotor stop 818.

In some embodiments, the geometries of the electronic lock cylinder described in the examples of the various figures may be modified, such as a mirror image. For example, the rotors described can be configured to rotate counter-clockwise instead to reach the locked state and clockwise to reach the unlocked state or vice versa.

The embodiments are described in sufficient detail to enable those skilled in the art to make and use the embodiments. It is to be understood that other embodiments would be evident based on the present disclosure, and that system, process, or mechanical changes may be made without departing from the scope described.

In the description, numerous specific details are given to provide a thorough understanding of the embodiments. However, it will be apparent that the embodiments may be practiced without these specific details. In order to avoid obscuring the embodiments, some well-known circuits, configurations, systems and process steps may not have been disclosed in detail.

The drawings showing embodiments are semi-diagrammatic and not to scale and, particularly, some of the dimensions are for the clarity of presentation and are shown exaggerated in the drawings. Similarly, although the views in the drawings for ease of description generally show similar orientations, this depiction in the figures is arbitrary for the most part. Generally, the embodiments can be operated in any orientation.

In addition, where multiple embodiments are disclosed and described having some features in common, for clarity and ease of illustration, description, and comprehension thereof, similar and like features one to another will ordinarily be described with similar reference numerals. The embodiments have been numbered first embodiment, second embodiment, etc. as a matter of descriptive convenience and are not intended to have any other significance or provide limitations.

While embodiments have been described in conjunction with a specific best mode, it is to be understood that many alternatives, modifications, and variations will be apparent to those skilled in the art in light of the description. Accordingly, it is intended to embrace all such alternatives, modifications, and variations that fall within the scope of the included claims. All matters hithertofore set forth herein or shown in the accompanying drawings are to be interpreted in an illustrative and non-limiting sense.

What is claimed is:

1. A lock cylinder comprising:

a plug assembly including a plug body, wherein the plug assembly has a front portion and a back portion and wherein the front portion has an antenna; and a housing shell including an interior surface defining an interior void in which the plug assembly is rotatably disposed, wherein the interior surface includes a notch;

wherein the back portion of the plug assembly comprises:

a rotor having at least two stable rotational configurations corresponding respectively to a locked state and an unlocked state of the lock cylinder, wherein the rotor is able to maintain each of the rotational stable configurations without consuming energy;

a locking pin that is movably disposed in a pin hole in the plug body, and wherein, when the locking pin is engaged in the notch and the locking pin is prevented from shifting away from the notch by the rotor, the locking pin prevents a rotation of the plug assembly with respect to the housing shell;

wherein, at a first stable configuration of the rotor, a long radius span of the rotor under the locking pin prevents the locking pin from shifting away from the notch, and, at a second stable configuration of the rotor, a short radius span of the rotor under the locking pin enables the locking pin to shift away from the notch;

a driver mechanically coupled to the rotor to turn the rotor; and an electronic circuitry to control the driver based on wireless signal received through the antenna.

2. The lock cylinder of claim 1, wherein the rotor is shaped such that whenever the locking pin is shifting into the plug body, the locking pin's contact with the rotor causes the rotor to spin back to the first stable configuration.

3. The lock cylinder of claim 1, wherein the rotational stable configurations are achieved via opposing rotational forces.

4. The lock cylinder of claim 3, wherein the opposing rotational forces are achieved, via at least one from a first magnet in the plug body repelling a second magnet in the rotor and at least one from a normal force of a rotor stop structure that limits the rotor's rotation beyond a certain angle.

5. The lock cylinder of claim 1, wherein the front portion is configured to protrude out from the housing shell as a turnable knob for turning the plug assembly when the lock cylinder is in the unlocked state.

6. The lock cylinder of claim 5, wherein the front portion includes a patterned surface that improves ergonomic property of the turnable knob or serves as a mechanism for adhering to an exterior of the front portion an attachable cover.

7. The lock cylinder of claim 1, wherein the driver is a DC motor, a solenoid actuator, or a servo motor.

8. A lock cylinder comprising:

a plug assembly including a plug body, wherein the plug assembly has a front portion and a back portion; and a housing shell including an interior surface defining an interior void in which the plug assembly is rotatably disposed, wherein the interior surface includes a first notch;

wherein the back portion of the plug assembly comprises:

a rotor having at least two stable configurations corresponding to respectively to a locked state and an unlocked state of the lock cylinder, wherein the rotor is able to maintain the stable configurations without consuming energy;

a locking pin that is movably disposed in a pin hole in the plug body, and wherein, when the locking pin is engaged in the first notch and the locking pin is prevented from shifting away from the first notch by the rotor, the locking pin prevents a rotation of the plug assembly with respect to the housing shell; and wherein, at a first stable configuration of the rotor, the rotor prevents the locking pin from shifting away from the first notch, and, at a second stable configuration of the rotor, the rotor enables the locking pin to shift away from the first notch;

wherein the rotor includes a rotor magnet and the plug body includes a body magnet; and wherein ends with the same magnetic polarity of the rotor magnet and the body magnet are aligned to repel from each other.

9. The lock cylinder of claim 8, wherein the housing shell or the plug assembly further comprises an electromagnetic field shielding.

10. The lock cylinder of claim 8, wherein the first notch has a prism or a chisel-tip shape and the locking pin has a prism or chisel-tip shape tip that fits into the first notch.

11. The lock cylinder of claim 8, wherein the back portion further comprises a locking pin spring that exerts a force to push the locking pin away from the rotor.

12. The lock cylinder of claim 8, wherein the locking pin spring is a torsion spring that extends substantially horizontally parallel to a geometric axle of the plug assembly.

13. The lock cylinder of claim 8, wherein the back portion further comprises a centering pin that fits into a second notch in the housing shell and is capable of retracting into the plug body.

14. The lock cylinder of claim 8, further comprising:

a motor mechanically coupled to the rotor to turn the rotor; and an electronic circuitry to control the motor based on an authentication signal.

15. The lock cylinder of claim 8, wherein the rotor is configured such that less than or equal a quarter turn of the rotor enables a switch between the stable configurations.

* * * * *